US005160221A

United States Patent [19]

Rohe et al.

[11] Patent Number: 5,160,221

[45] Date of Patent: Nov. 3, 1992

[54] WATERWAY LINER

[75] Inventors: Fred P. Rohe, Elk Rapids; Bret Bell, Traverse City, both of Mich.

[73] Assignee: Environmental Protection, Inc., Kalkaska, Mich.

[21] Appl. No.: 712,395

[22] Filed: Jun. 10, 1991

[51] Int. Cl.[5] ..... E02B 11/00

[52] U.S. Cl. ..... 405/270; 405/268

[58] Field of Search ..... 405/268, 270, 38

[56] References Cited

U.S. PATENT DOCUMENTS

| | | | |
|---|---|---|---|
| 1,363,690 | 12/1920 | Sullivan | 405/270 X |
| 4,050,972 | 9/1977 | Cardinal | 405/270 X |
| 4,184,786 | 1/1980 | Richards | 405/270 X |
| 4,828,432 | 5/1989 | Ives | 405/270 |
| 4,917,537 | 4/1990 | Jacobson | 405/270 X |
| 4,954,019 | 9/1990 | Giroux | 405/270 X |

*Primary Examiner*—Dennis L. Taylor

*Attorney, Agent, or Firm*—Gifford, Groh, Sprinkle, Patmore and Anderson

[57] ABSTRACT

A liner is disclosed for a waterway of the type adapted to overlie the bottom of the waterway while a cementious layer covers and protects the liner. The liner itself is positioned at the bottom of the waterway by a machine having two elongated and spaced apart guide rails, each having a hollow interior and a longitudinally extending slot open at each end. The liner includes an elongated, flexible and water impervious sheet of a geomembrane material, such as polyvinyl chloride (PVC) or polyethylene material, having two spaced apart side edges. A strand is secured along each edge of the sheet by wrapping a flap of the sheet around the strand so that the flap encircles and then flatly abuts against one side of the sheet. A heat seal between the flap and the sheet bonds the flap and sheet together and the enclosed strand is then longitudinally slidably positioned within the interior of one of the guide rails.

8 Claims, 1 Drawing Sheet

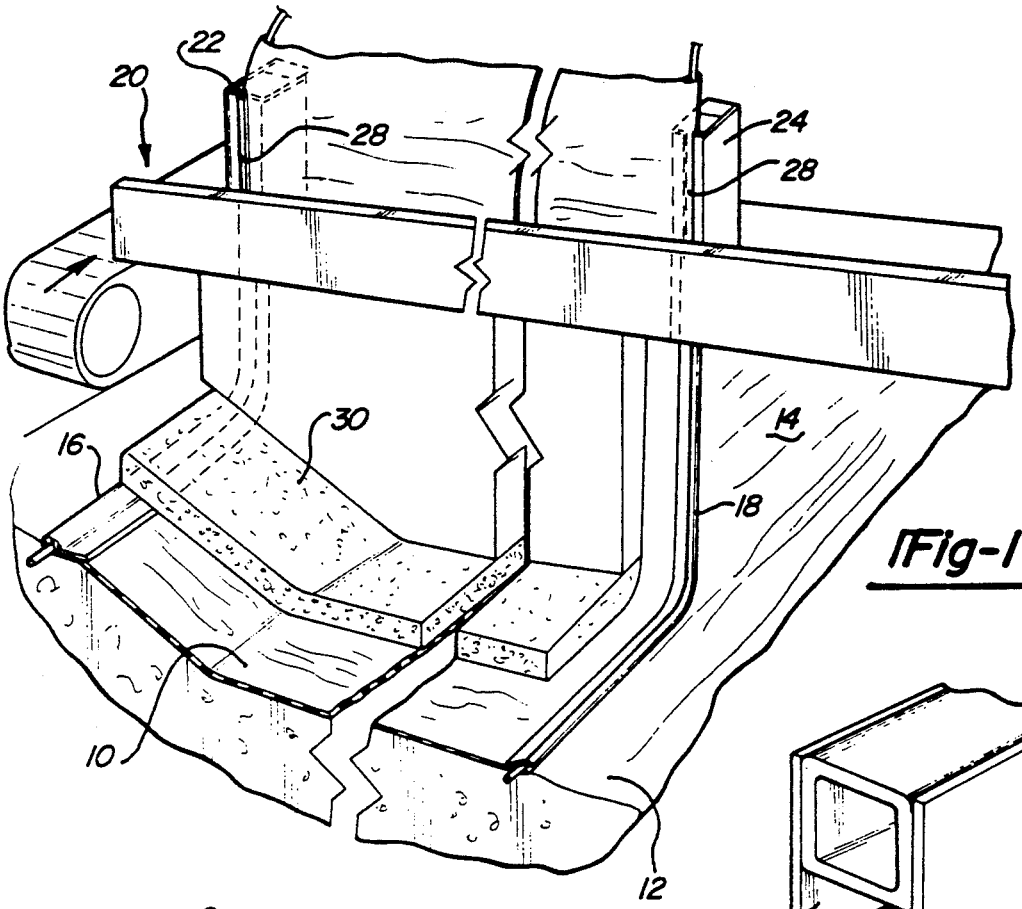
Fig-1
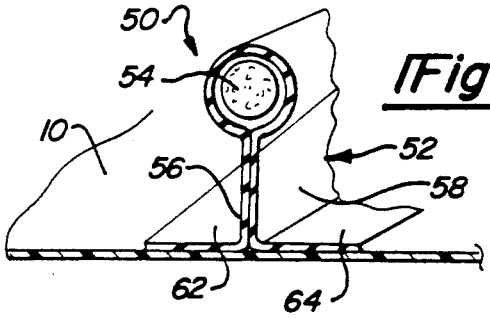
Fig-3
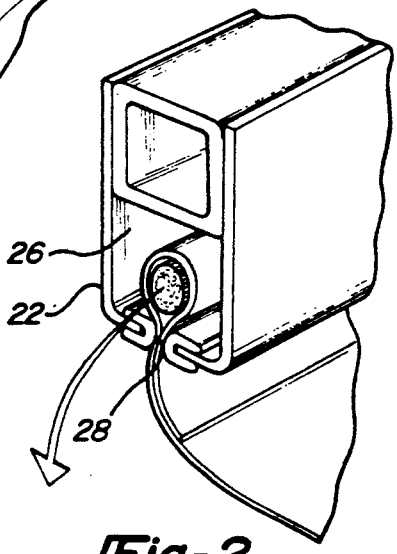
Fig-2
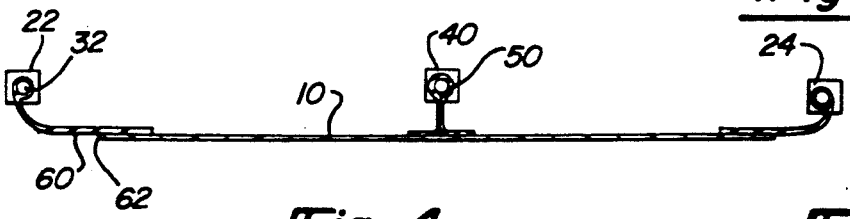
Fig-4
Fig-5
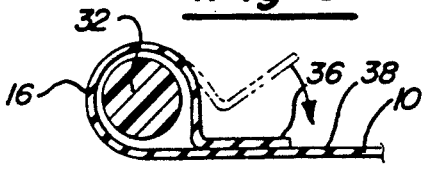

WATERWAY LINER

BACKGROUND OF THE INVENTION

I. Field of the Invention

The present invention relates generally to a liner for a waterway to minimize water loss through ground absorption.

II. Description of the Prior Art

Water or irrigation canals are used extensively in the southwestern portion of the United States for conveying water from the source of the water to a water processing plant. From the plant, the water is ultimately distributed to the end users.

These previously known canals typically comprise little more than a trough excavated through the land and through which the water flows. One disadvantage of these previously known canals, however, is that a great deal of water is lost through ground absorption. Such loss of water through ground absorption is unacceptable, especially during prolonged drought conditions.

One recently devised method for minimizing the loss of water through ground absorption involves laying a liner of a geomembrane material along the bottom of the canal. This liner is then held in place, as well as protected, by a cementious material which overlies and protects the liner. Furthermore, both the liner, as well as the cementious layer, are laid along the bottom of the canal while the canal is in use and thus at least partially filled with water.

In order to feed the liner so that it covers the bottom of the canal, a machine has been developed having a pair of spaced apart guide rails which slidably engage opposite sides of the sheet which forms the liner. Typically, these guide rails include a hollow interior having a longitudinally extending slot which extends along the length of the guide rail. A strand enclosed in a flap along the edge of the sheet is then positioned within the interior of the guide rail and is longitudinally slidable with respect to the guide rail.

One disadvantage of these previously known constructions, however, is that the flap was typically solvent welded around the strand and that the strand was relatively small in size. This, in turn, resulted in two problems.

First, there was a tendency that the strand would pull out of the channel slot when the sheet was subjected to lateral stress or tension. Even more serious, however, was that the solvent weld between the flap and the PVC sheet around the strand would fail under stress.

A still further problem arose when it was necessary to use a third guide rail positioned in between the outer two guide rails in order to guide the liner to the bottom of a canal. In order to secure a strand to the center of the PVC sheet, the strand was positioned along the sheet, the sheet wrapped around the strand and then secured together by solvent welding.

One disadvantage of this previously known method for securing a center guide strand to the sheet was that the solvent welding would fail when the sheet was subjected to lateral tension. This in turn can cause improper feeding of the liner into the canal and even possible jamming of the machine.

SUMMARY OF THE PRESENT INVENTION

The present invention provides a liner which overcomes all of the above mentioned disadvantages of the previously known devices.

In brief, the liner of the present invention comprises an elongated, flexible and water impervious sheet of a geomembrane material, such as polyvinyl chloride (PVC) or polyethylene. The sheet has two spaced apart side edges.

An elongated strand is positioned longitudinally adjacent each side of the sheet. A small flap then covers the strand so that one side of the flap flatly abuts against the sheet. The flap and sheet are then secured together by a heat seal which provides a much stronger bond than solvent welding.

The strand has a diameter greater than the diameter of the slot formed in the guide rail. Consequently, with the strand positioned within the hollow interior of the guide rail so that the sheet extends outwardly through the slot, the strand firmly, but longitudinally slidably, retains the strand as well as the edge of the liner within the guide rail.

In order to secure a center guide strand to the sheet, an elongated strip of liner material is first wrapped around the third strand so that two facing portions of the strip flatly abut against each other. A heat seal then bonds the two portions of the strip together in the area closely adjacent the strand thus leaving two loose and unattached flaps. These flaps are then spread apart from each other and then positioned flatly to abut against the midportion of the PVC sheet. These flaps are then secured to the sheet by solvent or heat welding. Since the integrity of the sheet is maintained across the central guide strand, failure of the central guide strand due to lateral tension on the sheet is eliminated.

BRIEF DESCRIPTION OF THE DRAWINGS

A better understanding of the present invention will be had upon reference to the following detailed description, when read in conjunction with the accompanying drawing, wherein like reference characters refer to like parts throughout the several views, and in which:

FIG. 1 is a diagrammatic view illustrating a preferred embodiment of the present invention;

FIG. 2 is a diagrammatic view illustrating a portion of the present invention;

FIG. 3 is a sectional view illustrating a central guide strand of the present invention; and FIG. 4 is an end view illustrating the preferred embodiment of the present invention; and FIG. 5 is a sectional view illustrating a feature of the invention.

DETAILED DESCRIPTION OF A PREFERRED EMBODIMENT OF THE PRESENT INVENTION

With reference first to FIG. 1, a preferred embodiment of the liner 10 of the present invention is thereshown for covering the bottom 12 of a waterway, such as a canal 14.

The liner 10 comprises an elongated sheet having two sides 16 and 18. The sheet 10 is constructed from a flexible and water impervious geomembrane material, such as polyvinyl chloride or polyethylene, and preferably has a thickness of 10–60 mils and preferably substantially 30 mils.

A machine 20, illustrated diagrammatically in FIG. 1, is provided for positioning the liner 10 along the bottom 12 of the waterway 14 even while the waterway 14 is in use and thus partially filled with water. This machine 20 includes a pair of elongated and generally vertically extending guide rails 22 and 24 which longitudinally slidably engage the opposite sides 16 and 18, respectively, of the liner 10. As best shown in FIGS. 1 and 2, each guide rail 22 and 24 includes a generally hollow interior 26 as well as an elongated slot 28 which is open to the interior 26. The slot 28 in each rail 22 and 24 is open to both the top of the rail 22 or 24 as well as the bottom of the rail 22 or 24 adjacent the bottom 12 of the waterway 14.

Referring again to FIG. 1, once the liner 10 is positioned along the bottom 12 of the waterway, an overlie layer 30 is applied across the top of the liner 10 by the machine 20. This overlie layer 30 preferably comprises cementious material which both protects the liner 10 as well as holds the liner 10 in position along the bottom 12 of the waterway 14. Other materials, such as dirt or aggregate, can be used as the overlie layer 30.

With reference now to FIGS. 2 and 5, in order to slidably attach the side edges 16 and 18 of the liner to their respective rails 22 and 24, an elongated strand 32 is positioned longitudinally along each edge 16 and 18 of the sheet 10. As best shown in FIG. 5, the strand 32, which can be constructed of any conventional material, is spaced slightly inwardly from the edge 16.

The outermost edge of the sheet 14 is then folded over the strand 32 as indicated in phantom line so that a small flap 36 flatly abuts against one side 38 of the sheet 14. This flap 36 is then bonded to the side 38 of the sheet 14 by a heat seal thus fixedly securing the flap 36 and sheet 10 together. Simultaneously, the strand 32 is attached to the sheet 10 along its edge 16.

A second strand is similarly attached to the opposite edge 18 of the sheet 10. Therefore, in order to avoid redundancy, a further description thereof is unnecessary.

As best shown in FIG. 2, with the strand 32 secured along the edge 16 of the sheet in the previously described fashion, the strand 32 is positioned within the interior 26 of the guide rail 22 and so that the flap 16 and sheet 10 extend outwardly through the slot 28. The strand 32 has a diameter greater than the width of the slot 28 and thus retains the edge 16 of the sheet 10 within the interior of the guide rail 22 despite lateral tensioning of the sheet 10. The strand 32, with its attached sheet 10, can slide longitudinally with respect to the guide rail 22 in the desired fashion.

In operation and with the machine 20 laying the sheet 10 along the bottom 12 of the waterway in the previously described fashion, lateral stresses and tension are frequently applied to the sheet 10. It has been found that heat sealing the flap 36 to the sheet 10 sufficiently bonds the sheet 10 and flap 36 together against failure despite these stresses.

With reference now to FIGS. 3 and 4, in some situations, the use of only two guide rails 22 and 24 at opposite side edges of the sheet 10 are inadequate and insufficient for properly guiding the liner 10 along the waterway bottom 12. In these cases, it is necessary that the machine 20 (FIG. 1) include a third guide rail positioned at a midpoint between the side guide rails 22 and 24. In such situations, it is necessary to attach a center guide strand to the sheet 10 which, in turn, longitudinally slides through the central guide rail.

With reference then to FIG. 4, a diagrammatic end view is thereshown of the liner 10 longitudinally slidably positioned through the edge rails 22 and 24, as well as a further central guide rail 40. A central guide strand 42 is secured to the liner 10 and is in turn longitudinally slidably received through the central guide rail 40.

With reference then to FIG. 3, a better view of the central guide strand 50 is thereshown and comprises an elongated strip 52 of geomembrane material. A center portion of the strip 52 is wrapped around a strand 54 so that two portions 56 and 58 flatly abut against each other. These flatly abutting portions 56 and 58 are then secured together by any conventional means, such as solvent welding, heat welding or the like.

The portions 56 and 58 are attached together such that two flaps 62 and 64 remain unattached to each other and are positioned so that they flatly abut against the sheet 10. These flaps 62 and 64 are then secured to the sheet by any conventional means, such as solvent welding, thereby securing the guide strand 50 to the sheet 10 in the desired fashion.

With reference now to FIG. 4, in some situations, it facilitates the manufacture of the liner if a relatively short width sheet extension 60 is first constructed with the guide strand 32 secured along the edge of the sheet extension 60 as in the previously described fashion. This sheet extension 60 is then attached to an edge 62 of the liner 10 by conventional means, such as solvent welding, when final assembly of the liner 10 is desired. Consequently, separate construction of the sheet extension from the liner 10, in some situations, facilitates handling, shipping and the like of the overall liner.

Having described our invention, many modifications thereto will become apparent to those skilled in the art to which it pertains without deviation from the spirit of the invention as defined by the scope of the appended claims.

We claim:

1. In combination, a liner for a waterway and a machine for laying the liner along a bottom of the waterway, said liner adapted to overlie the bottom of the waterway while an overlie layer covers said liner, said machine having two elongated, spaced apart and parallel guide rails, said guide rails extending substantially vertically and each rail having a hollow interior and longitudinally extending slot open at each end and open to the interior of said rail, said liner comprising:

an elongated, flexible and water impervious sheet of geomembrane material, said sheet having two spaced apart side edges, means for longitudinally slidably mounting said side edges of said sheet to each of said rails so that said sheet extends between said rails, said slidable mounting means comprising a strand extending longitudinally adjacent each edge of said sheet and means for securing said strand to said sheet, said strand having a diameter greater than the width of said slot, wherein said strand securing means comprises a flap along each edge of said sheet wrapped around and encircling its associated strand so that one side of said flap flatly abuts against the sheet, heat sealing means for bonding said one side of said flap an said sheet together, wherein said strand is longitudinally slidably positioned within the interior of said rail, said strand having a diameter greater than the width of said slot.

2. The invention as defined in claim 1 wherein said machine includes a third guide rail between and parallel to said first two mentioned rails, and wherein said liner comprises a third strand and means for mounting said third strand to one side of said sheet so that said third strand is positioned between and parallel to said first two mentioned strands.

3. The invention as defined in claim 2 wherein said third strand mounting means comprises a polyvinyl chloride strip, said strip being wrapped around said third strand so that two facing portions of said strip flatly abut against each other, heat sealing means for bonding said portions together thereby forming two flaps, and means for securing said flaps to said one side of said sheet.

4. The invention as defined in claim 1 wherein said sheet is 10–60 mils thick.

5. The invention as defined in claim 1 wherein said sheet comprises polyvinyl chloride.

6. The invention as defined in claim 1 wherein said sheet comprises polyethylene.

7. The invention as defined in claim 1 wherein said overlie layer comprises a cementious material.

8. In combination, a liner for a waterway and a machine for laying the liner along a bottom of the waterway, said liner adapted to overlie the bottom of the waterway while a cementious layer covers said liner, said machine having two elongated, spaced apart and parallel guide rails, said guide rails extending substantially vertically and each rail having a hollow interior and longitudinally extending slot open at each end and open to the interior of said rail, said liner comprising:

an elongated, flexible and water impervious sheet of polyvinyl chloride material, said sheet having two spaced apart side edges, at least one elongated sheet extension having two spaced apart and parallel edges, a strand extending longitudinally adjacent one edge of said sheet extension, means for securing said strand to said sheet extension comprising a flap along said one edge of said sheet extension, said flap being wrapped around and encircling its associated strand so that one side of said flap flatly abuts against the sheet extension, heat sealing means for bonding said one side of said flap and said sheet extension together, means for securing the other edge of said sheet extension along one edge of said sheet, wherein said strand has a diameter greater than the width of said slot, said strand being longitudinally slidably positioned within the interior of one rail.

* * * * *